US010107556B2

(12) United States Patent
Buckrell et al.

(10) Patent No.: US 10,107,556 B2
(45) Date of Patent: Oct. 23, 2018

(54) CONICAL HEAT EXCHANGER

(71) Applicant: Dana Canada Corporation, Oakville (CA)

(72) Inventors: Andrew J. M. Buckrell, Kitchener (CA); Colin A. Shore, Hamilton (CA); Michael J. R. Bardeleben, Oakville (CA); Nikolas S. Stewart, Halton Hills (CA); Benjamin A. Kenney, Ottawa (CA)

(73) Assignee: Dana Canada Corporation, Oakville, Ontario (CA)

( * ) Notice: Subject to any disclaimer, the term of this patent is extended or adjusted under 35 U.S.C. 154(b) by 712 days.

(21) Appl. No.: 14/576,286

(22) Filed: Dec. 19, 2014

(65) Prior Publication Data

US 2015/0176913 A1 Jun. 25, 2015

Related U.S. Application Data

(60) Provisional application No. 61/918,188, filed on Dec. 19, 2013.

(51) Int. Cl.
*F28D 9/00* (2006.01)
*F28F 9/02* (2006.01)
(Continued)

(52) U.S. Cl.
CPC ..... *F28D 9/0012* (2013.01); *F28D 9/0043* (2013.01); *F28D 9/0062* (2013.01);
(Continued)

(58) Field of Classification Search
CPC ..... F28D 9/0012; F28D 9/0043; F28D 9/04; F28D 9/0062; F28F 9/0246; F28F 3/025
(Continued)

(56) References Cited

U.S. PATENT DOCUMENTS 2,229,306 A 1/1941 Prestage
3,026,571 A 3/1962 Maier
(Continued)

FOREIGN PATENT DOCUMENTS

GB 987124 A 3/1965
GB 1061258 A 3/1967
(Continued)

*Primary Examiner* — Raheena R Malik
(74) *Attorney, Agent, or Firm* — Marshall & Melhorn, LLC

(57) ABSTRACT

A heat exchanger having a conical-shaped core is disclosed. A first set of flow passages is formed between mating conical-shaped core plates, the mating plates forming plate pairs that are spaced apart from each other forming a second set of flow passages therebetween. A pair of oppositely disposed fluid openings are provided for inletting/discharging a fluid to/from the heat exchanger in a co-axial manner, the fluid openings being interconnected by a pair of fluid manifolds formed in the outer perimeter of the core, the second set of flow passages and a fluid manifold formed centrally through the heat exchanger. A second set of inlet/outlet manifolds formed within the perimeter of the core are interconnected by the first set of flow passages. Flow through the first set flow passages is peripheral around the perimeter of the conically-shaped core plates while flow through the second set of flow passages is along the angle defined by the conical-shaped plates.

32 Claims, 22 Drawing Sheets

(51) Int. Cl.
*F28F 3/02* (2006.01)
*F28F 13/06* (2006.01)
*F28D 21/00* (2006.01)

(52) U.S. Cl.
CPC ..... *F28F 3/025* (2013.01); *F28F 9/0246* (2013.01); *F28F 9/0265* (2013.01); *F28F 13/06* (2013.01); *F28D 21/0003* (2013.01); *F28D 2021/0082* (2013.01); *F28F 2009/029* (2013.01)

(58) Field of Classification Search
USPC ..... 165/154, 141, 167
See application file for complete search history.

(56) References Cited

U.S. PATENT DOCUMENTS 3,228,466 A 1/1966 Carleton
3,241,598 A 3/1966 Ramen
3,303,877 A * 2/1967 Ramen ..... F28D 9/04 165/141
3,542,521 A * 11/1970 Kulling ..... C01F 7/58 165/141
4,402,361 A 9/1983 Dominguez
5,022,379 A * 6/1991 Wilson, Jr. ..... F28D 7/103 122/18.3
6,340,054 B1 * 1/2002 Schwarz ..... F01M 5/002 165/153
6,688,261 B2 * 2/2004 Smith ..... F24H 1/28 122/155.1
8,081,729 B2 12/2011 Cros
2010/0012303 A1 1/2010 Domen
2011/0240008 A1 10/2011 Kesseli et al.
2012/0241120 A1 * 9/2012 Hagel ..... B60H 1/00492 165/10

FOREIGN PATENT DOCUMENTS

WO 96/07467 A1 3/1996
WO 2013/159232 A1 10/2013

* cited by examiner

CONICAL HEAT EXCHANGER

CROSS-REFERENCE TO RELATED APPLICATION

This application claims priority to and the benefit of U.S. Provisional Patent Application No. 61/918,188, filed Dec. 19, 2013 under the title CONICAL HEAT EXCHANGER. The content of the above patent application is hereby expressly incorporated by reference into the detailed description of the present application.

TECHNICAL FIELD

The specification generally relates to heat exchangers having a conical-shaped core.

BACKGROUND

Gas-to-liquid and liquid-to-liquid heat exchangers have numerous applications. For example, in vehicles, gas-to-liquid heat exchangers can be used to cool compressed charge air in turbocharged internal combustion engines or in fuel cell engines. Gas-to-liquid heat exchangers can also be used to cool hot engine exhaust gases. Liquid-to-liquid heat exchangers may be used for transmission oil cooling and/or engine oil cooling applications as well.

Various constructions of gas-to-liquid or liquid-to-liquid heat exchangers are known. For example, it is known to construct heat exchangers comprised of two or more concentric tubes, with the annular spaces between adjacent tubes serving as fluid flow passages. Corrugated fins are typically provided in the flow passages to enhance heat transfer and, in some cases, to join together the tube layers. It is also known to construct heat exchangers comprising a core constructed from stacks of tubular members or plates or plate pairs which provide alternating fluid flow passages (e.g. gas-to-liquid or liquid-to-liquid) for heat transfer between the two different fluids flowing through the alternating passages. In instances where the heat exchanger is formed as a multi-pass heat exchanger, the fluid flowing through the fluid flow passages switch-backs through 90 degree turns in order to travel through the various stages or passes of the heat exchanger.

Each specific application, whether it is a gas-to-liquid or liquid-to-liquid application, has its own heat exchanger requirements as well as space constraints and/or packaging requirements. It has been found that providing a conical-shaped heat exchanger for certain applications can result in desired heat exchange requirements as well as achieve certain space/packaging restrictions.

SUMMARY OF THE PRESENT DISCLOSURE

In accordance with an exemplary embodiment of the present disclosure there is provided a heat exchanger comprising a heat exchanger core comprising a plurality alternatingly stacked conically-shaped core plates defining a first set of flow passages between adjacent plates in a plate pair and a second set of flow passages between adjacent plate pairs forming the heat exchanger core, the first and second flow passages being in alternating order through the heat exchanger core; a pair of first inlet manifolds in fluid communication with said second set of flow passages, the pair of inlet manifolds being arranged generally opposite to each other at the perimeter of the heat exchanger core; a first outlet manifold in fluid communication with said second set of flow passages, the outlet manifold being formed centrally through the heat exchanger core; a second inlet manifold in fluid communication with said first flow passages, said second inlet manifold formed within the perimeter of the heat exchanger core; a second outlet manifold in fluid communication with said first flow passages, said second outlet manifold formed within the perimeter of the heat exchanger core; wherein flow through the first set flow passages is peripheral around the perimeter of core plates forming the plate pairs, and flow through the second set of flow passages is along the angle defined by the conically-shaped core plates between said plate pairs.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Reference will now be made in detail to exemplary implementations of the technology. The example embodiments are provided by way of explanation of the technology only and not as a limitation of the technology. It will be apparent to those skilled in the art that various modifications and variations can be made in the present technology. Thus, it is intended that the present technology cover such modifications and variations that come within the scope of the present technology.

A heat exchanger 10 according to a first exemplary embodiment of the present disclosure is now described below with reference to FIGS. 1 to 21.

Heat exchanger 10, in accordance with the first exemplary embodiment, may be used as a charge-air-cooler (CAC) in an automobile or motor vehicle. Accordingly, the heat exchanger 10 includes inlets, outlets and flow passages for air and for a liquid coolant, such as water, for example. However, it will be understood that heat exchanger 10 is not intended to be limited to such an application (e.g. a CAC) and any reference to heat exchanger 10 being a charge-air-cooler is intended to be exemplary. For instance, further exemplary embodiments of the heat exchanger 10 will be described in connection with transmission oil or engine oil cooling, in which case the heat exchanger may be a liquid-to-liquid heat exchanger. Heat exchanger 10 may also be adapted for water-cooled charge-air-cooler (WCAC) applications as well as exhaust-gas heat recovery (EGHR) applications.

Figure 1:
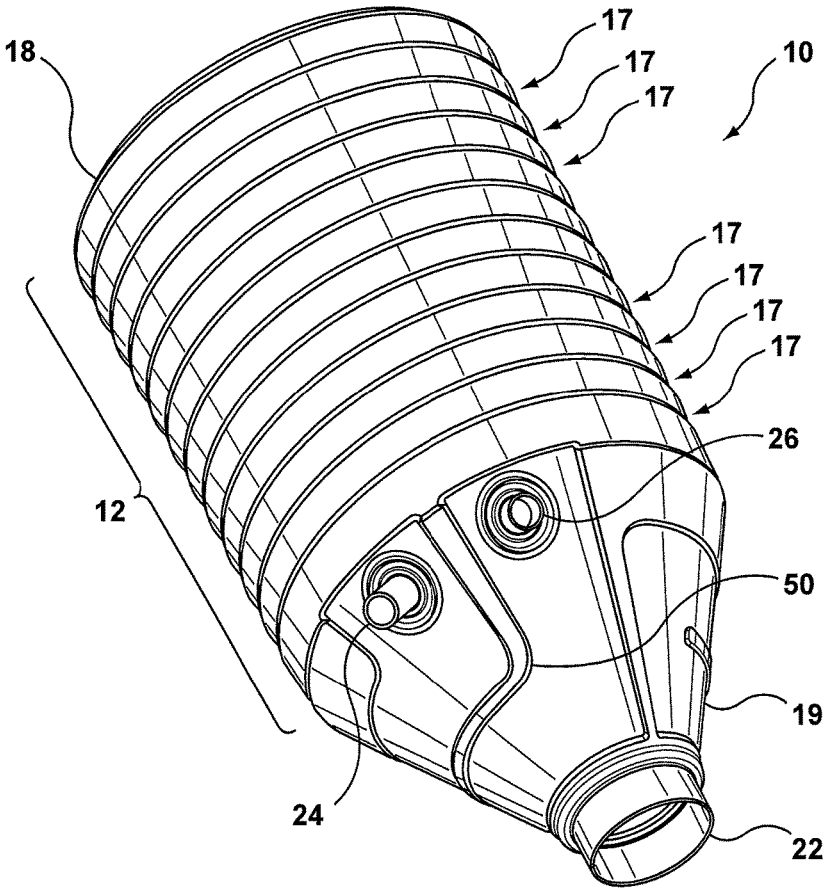
FIG. 1 is a perspective view of a heat exchanger according to a first exemplary embodiment of the present disclosure.
Figure 1A:
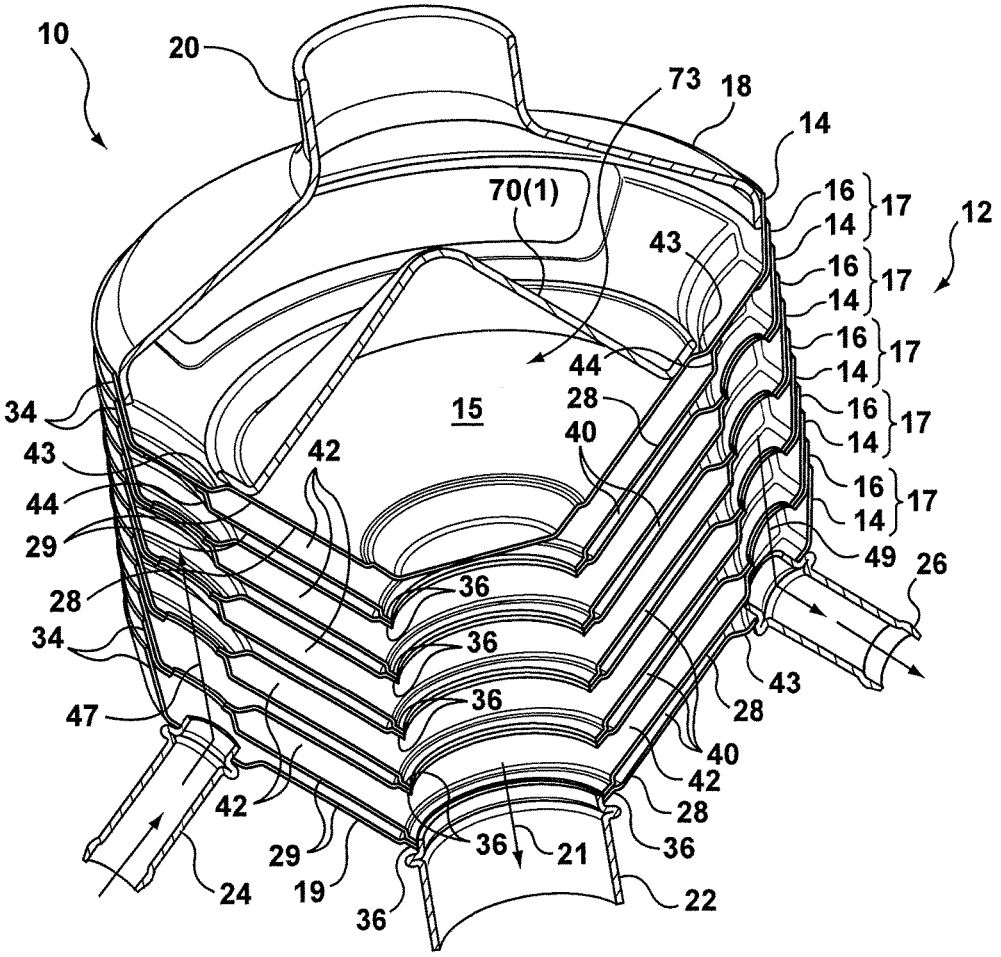
FIG. 1A is a perspective, cutaway view of a heat exchanger according to the first embodiment of the present disclosure.
Figure 2:
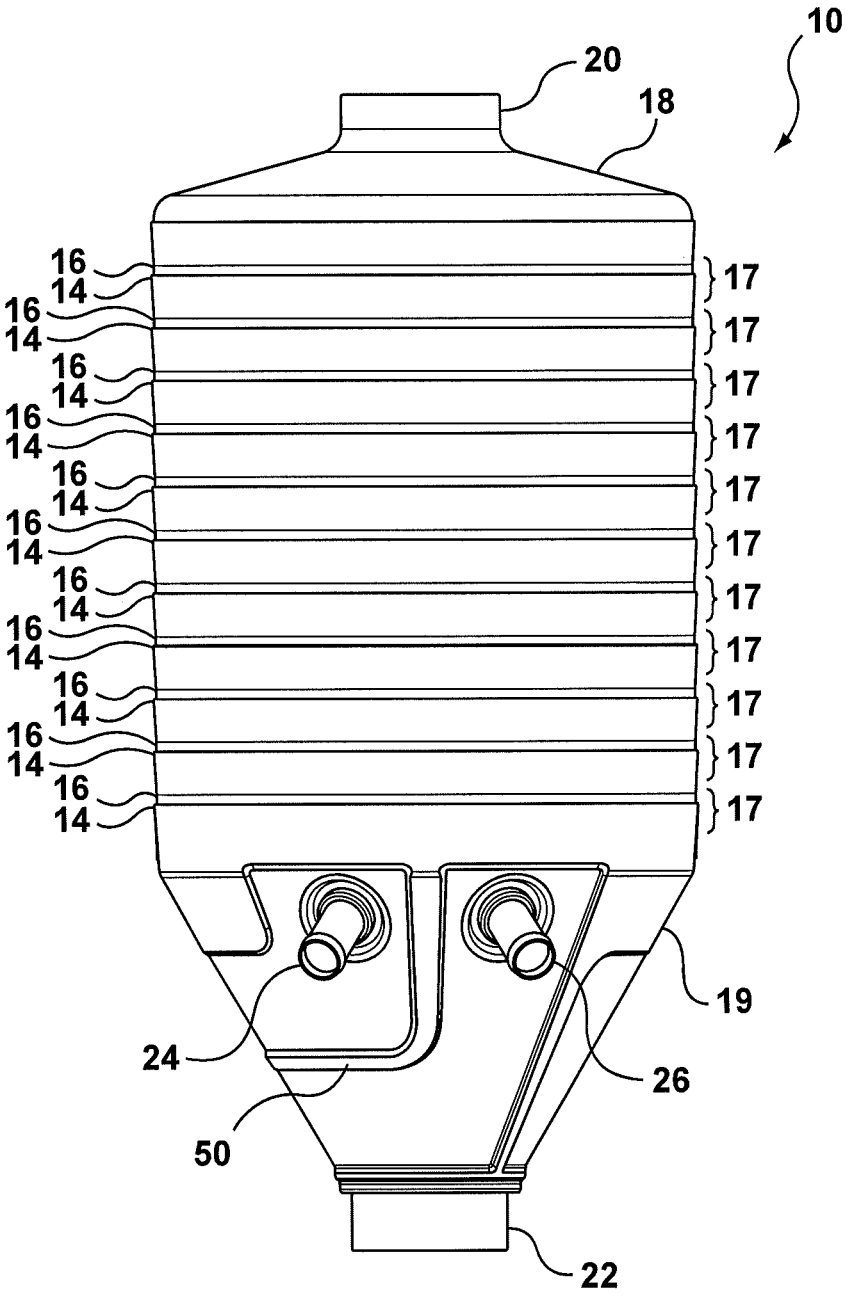
FIG. 2 is a front elevation view of the heat exchanger of FIG. 1.
Figure 3:
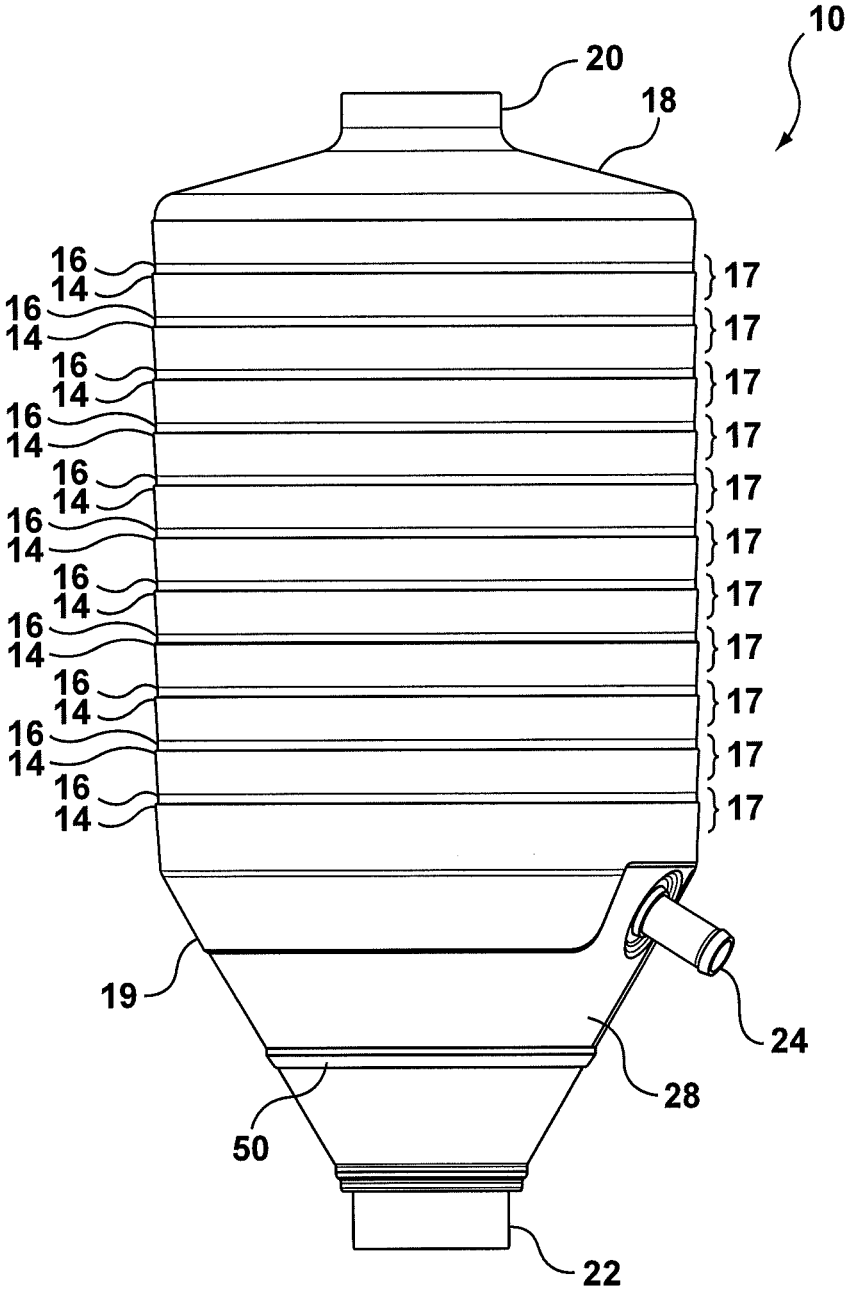
FIG. 3 is a side elevation view of the heat exchanger of FIG. 1.
Figure 4:
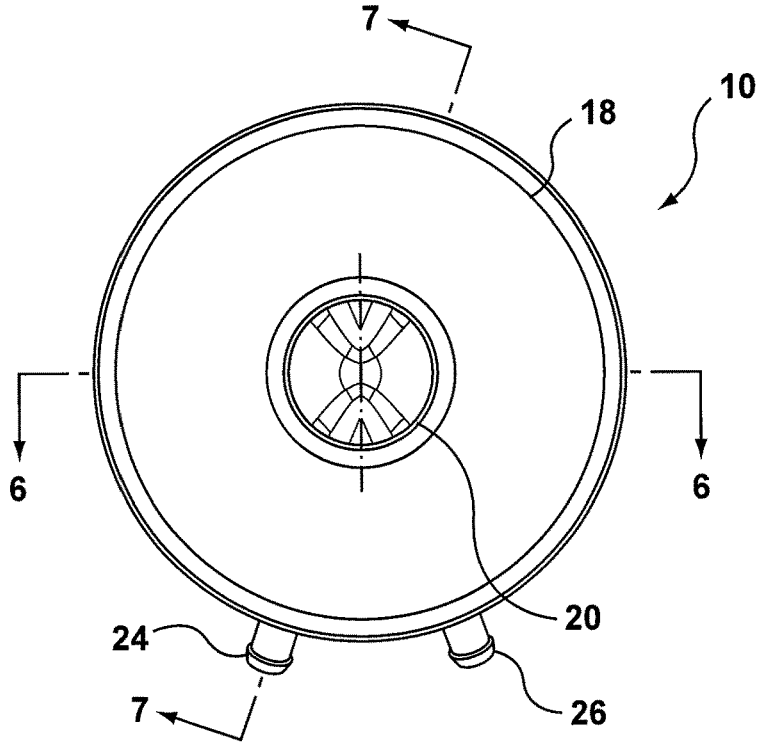
FIG. 4 is a top view of the heat exchanger as shown in FIG. 2.
Figure 5:
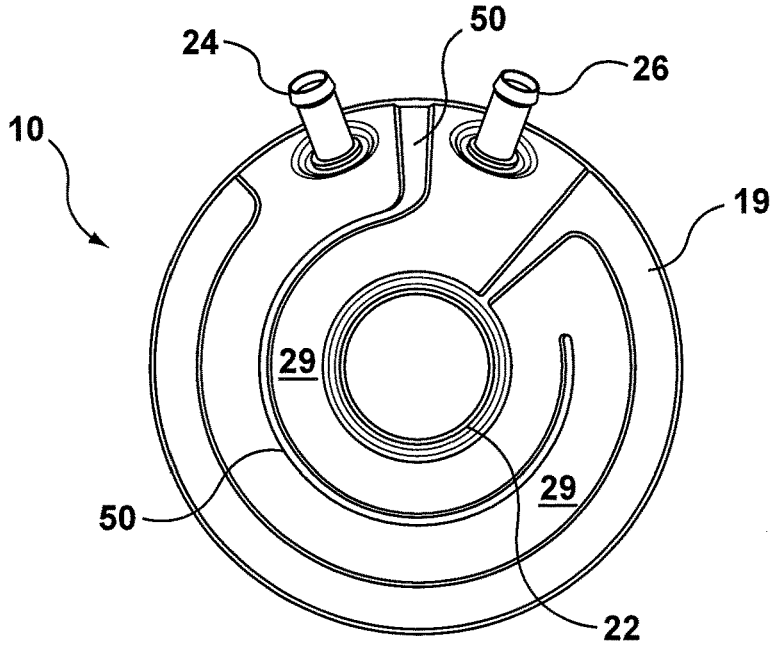
FIG. 5 is a bottom view of the heat exchanger as shown in FIG. 2.
Figure 6:
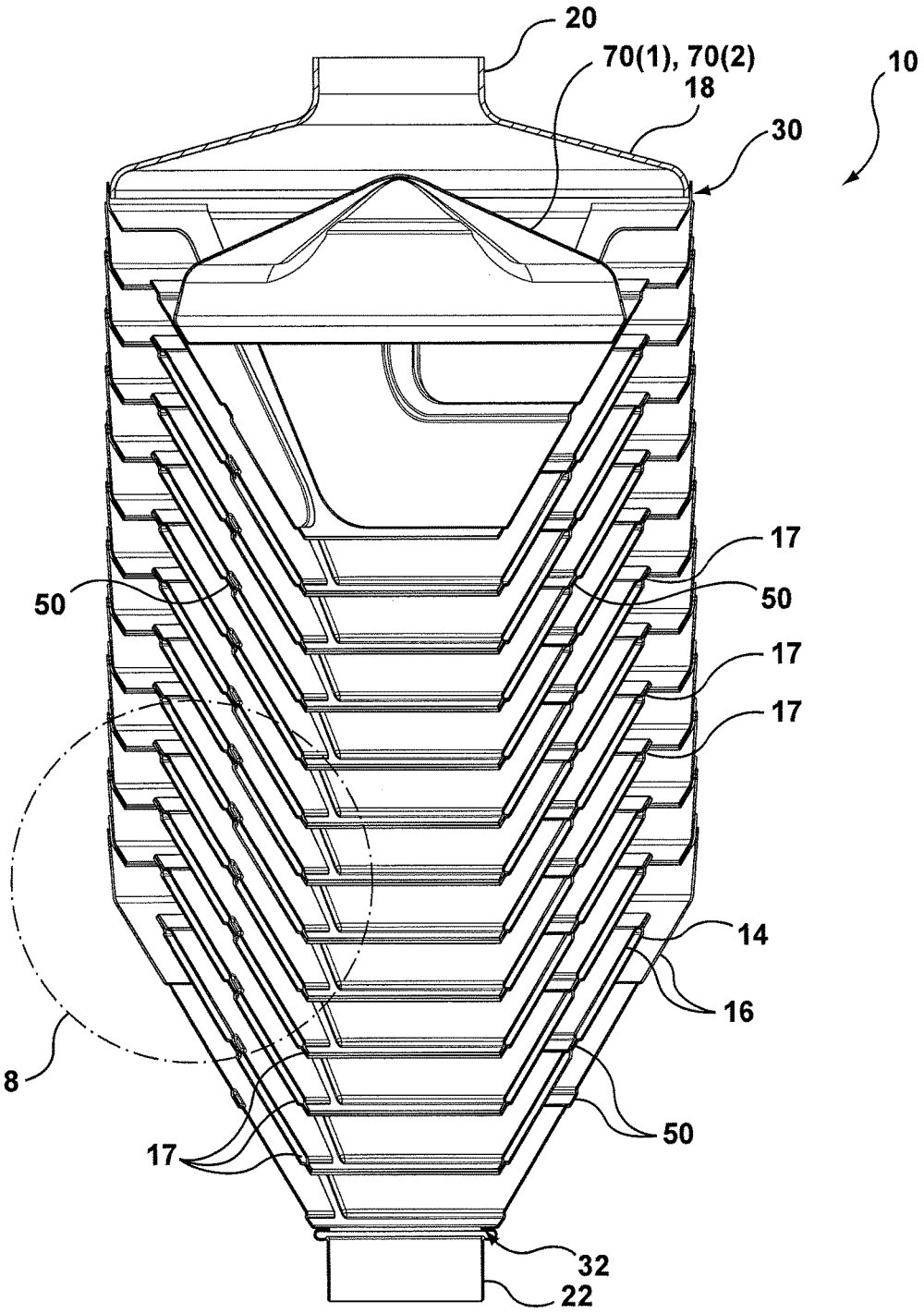
FIG. 6 is a longitudinal cross-section along line 6-6 of FIG. 4.
Figure 7:
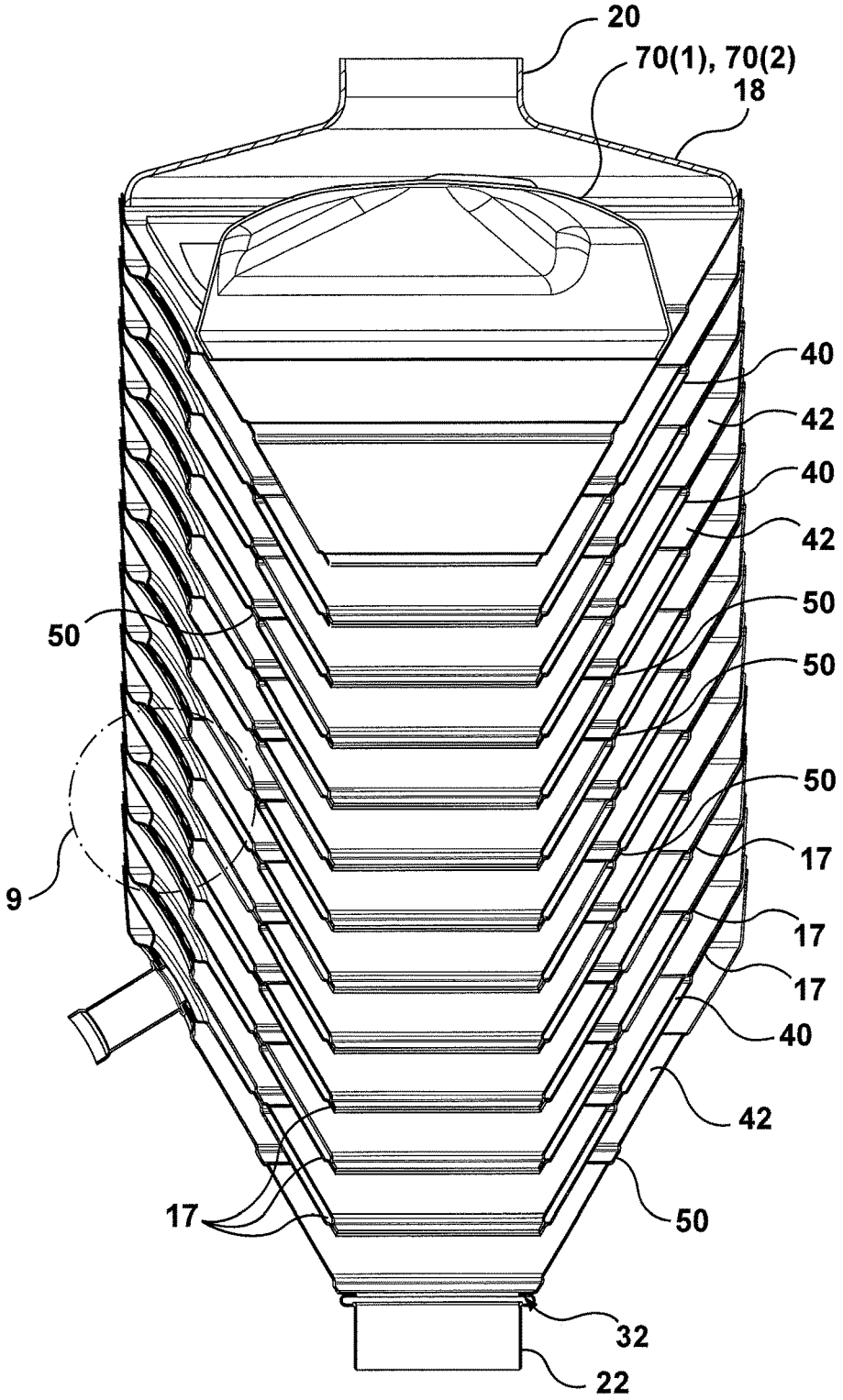
FIG. 7 is a longitudinal cross-section along line 7-7 of FIG. 4.
Figure 8:
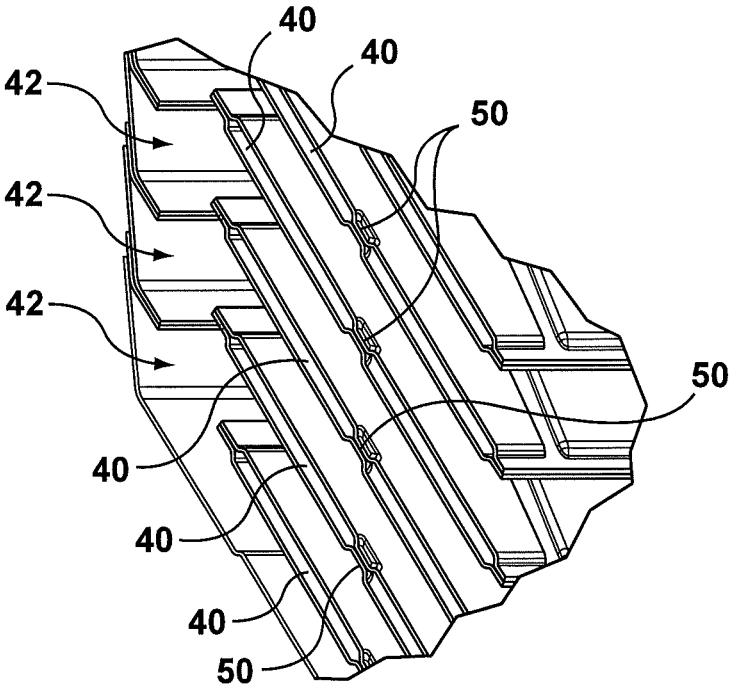
FIG. 8 is a detail view the encircled portion 8 in FIG. 6.
Figure 9:
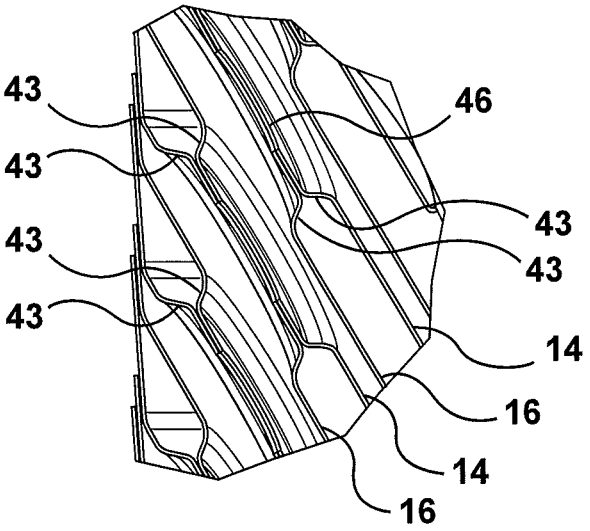
FIG. 9 is a detail view the encircled portion 9 in FIG. 7.
Figure 10:
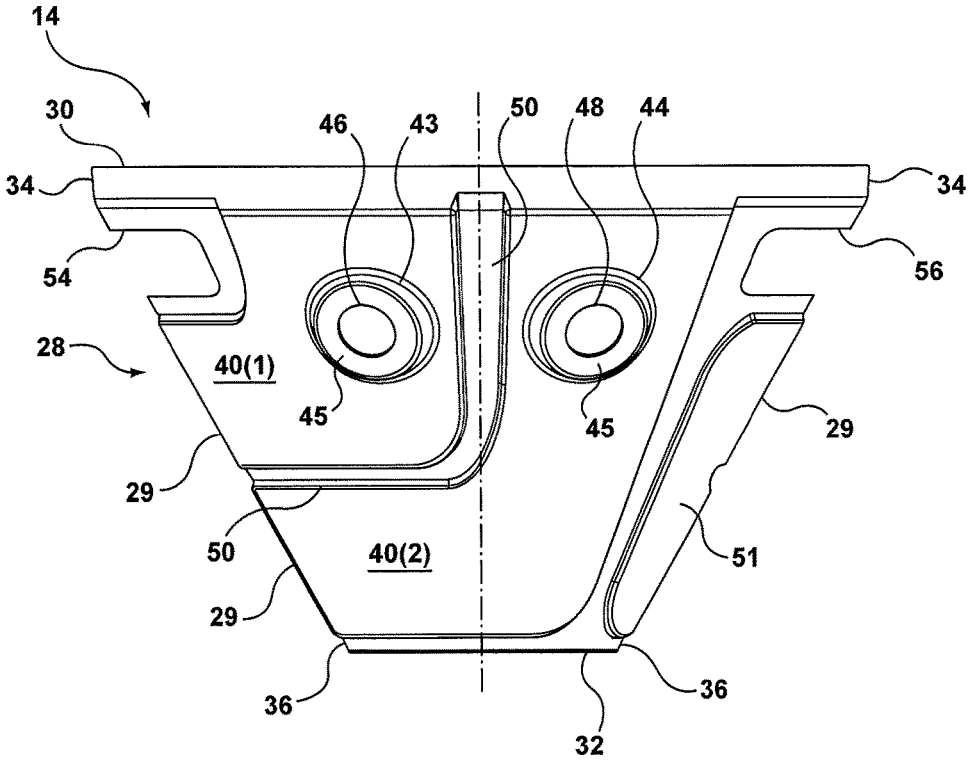
FIG. 10 is a front elevation view of one of the core plates forming the heat exchanger of FIG. 1.
Figure 11:
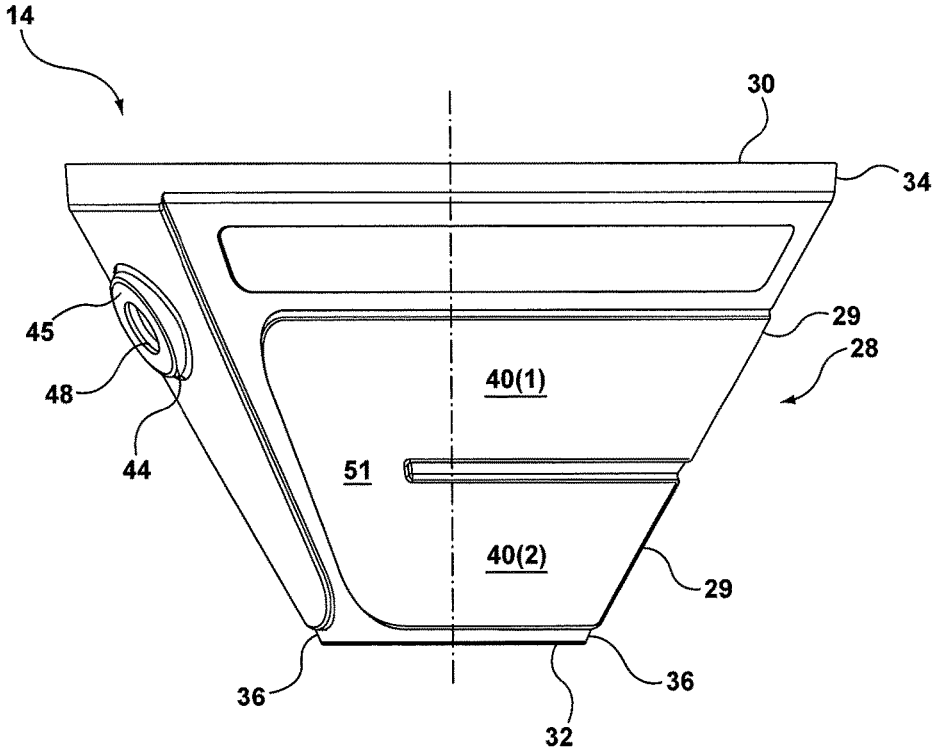
FIG. 11 is a right side view of the core plate of FIG. 10.
Figure 12:
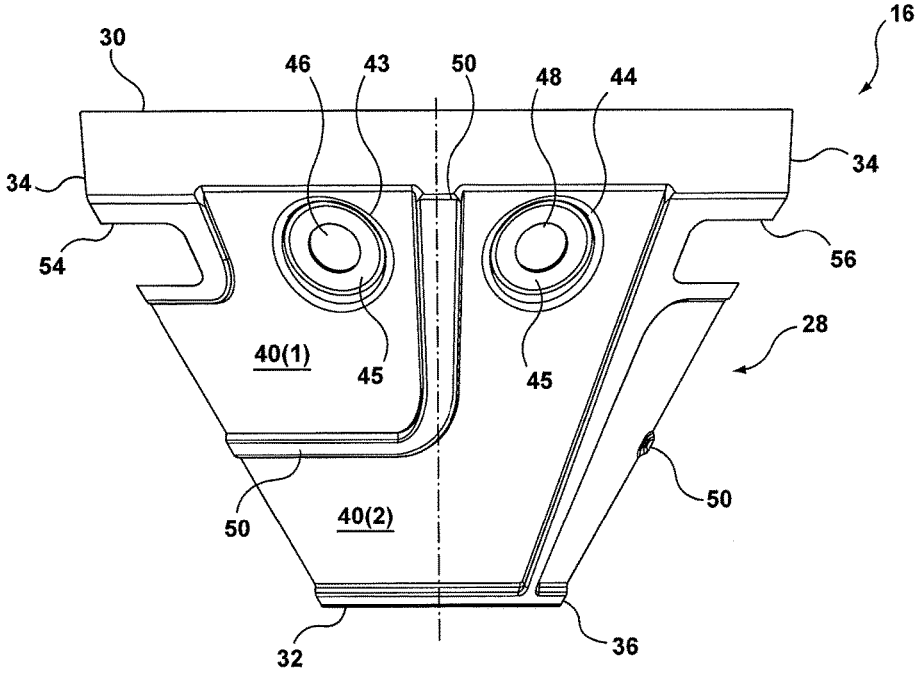
FIG. 12 is a front elevation view of the other core plate forming the heat exchanger of FIG. 1.
Figure 13:
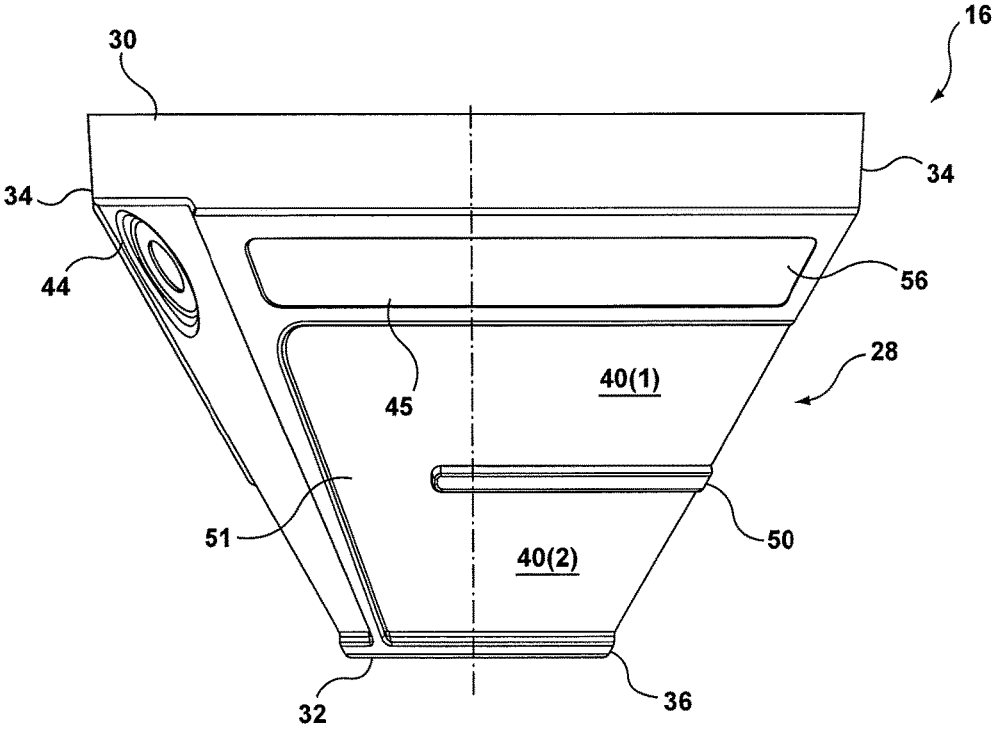
FIG. 13 is a right side view of the core plate of FIG. 12.

Referring now to FIGS. 1 and 1A, heat exchanger 10 has a core 12 comprising a plurality of conical-shaped core plates 14, 16 that are alternatingly stacked together in nesting relationship to one another forming plate pairs 17, a plurality of plate pairs 17 being stacked together to form the heat exchanger core 12. End plate 18 seals or encloses a first end of the heat exchanger core 12 and defines a fluid opening 20, which in this example embodiment is an inlet opening for receiving a first fluid, such as air when the heat exchanger 10 is in the form of a charge-air-cooler (CAC), for example. End plate 19, which may be in the form of one of the core plates 14, is arranged at the opposed end of the heat exchanger 10 and encloses the second end of the heat exchanger core 12. A fluid opening 22, which in this example embodiment serves as an outlet opening 22 is in the form of a fluid fitting and is arranged at the opposed end of the heat exchanger 10 for discharging the first fluid (for example, air, when in the form of a CAC) therefrom. While reference has been made to the inlet opening 20 being formed in end plate 18 and to the outlet opening 22 being arranged in end plate 19 at the opposed end of the heat exchanger 10, it will be understood that the location of the inlet and openings 20, 22 is intended to be exemplary and that, in some applications, the fluid opening 22 arranged in end plate 19 may serve as an inlet opening while fluid opening 20 in end plate 18 may serve as an outlet opening depending upon the particular application of the heat exchanger 10.

Heat exchanger 10 also comprises a second fluid inlet 24 for inletting a second fluid, such as water or any other suitable liquid coolant, to the heat exchanger 10 and a second fluid outlet 26 for discharging the second fluid therefrom. The second fluid inlet and outlet 24, 26 are arranged proximal the second end of the heat exchanger 10 and, in the subject embodiment are arranged generally adjacent to each other so that flow through the fluid channels formed by the mating core plates 14, 16 is in a counter-flow layout or arrangement. However, it will be understood that in other embodiments, the second fluid inlet and outlet 24, 26 may be circumferentially spaced apart from each other or arranged generally opposite to each other depending upon the particular application and/or required locations for the fluid fittings 24, 26.

In the subject exemplary embodiment, the heat exchanger core 12 is self-enclosed, meaning that the fluid inlet and outlet manifolds and the fluid flow passages are completely enclosed within the stack of conically-shaped plate pairs 17 made up of mating core plates 14, 16. Accordingly, in the subject exemplary embodiment, the heat exchanger 10 does not require an outer housing enclosing the stack of plate pairs 17.

As illustrated, the heat exchanger core 12 is comprised of plate pairs 17 that are each comprised of mating core plates 14, 16 each having a generally conically shaped sidewall 28 that generally tapers between a first, open end 30 to a second, smaller open end 32 as shown for instance in FIGS. 10-13. An upwardly extending flange 34 surrounds the first, open end 30 of core plates 14, 16, the second, open end 32 being defined by a peripheral flange 36 that extends generally parallel to the angle of the conical sidewall 28.

The generally conically-shaped sidewall 28 of core plates 14, 16 are each shaped or contoured so that when the core plates 14, 16 are alternatingly stacked together forming plate pairs 17, they each have a central portion 29 that is spaced apart from the adjacent plate 14, 16 thereby forming a set of internal flow passages 40 between the spaced-apart central portions 29 of the plates 14, 16 when the plates 14, 16 are arranged in their mating relationship. Another set of flow passages 42 is formed between adjacent sets of the mating core plates 14, 16 or plate pairs 17. In the case of a charge-air-cooler, flow passages 42 are "airside" flow passages while flow passages 40 are "liquid" or "coolant" flow passages.

Each plate 14, 16 is formed with a pair of embossments or boss portions 43, 44 that are raised out of the surface of the central portion 29 of the plates 14, 16. As shown in FIG. 1A, the boss portions 43, 44 formed in core plates 14 are oppositely disposed with respect to the boss portions 43, 44 formed in the mating core plates 16 (see for instance FIGS. 11-13). Therefore, when the core plates 14, 16 are alternatingly stacked together to form plate pairs 17, the boss portions 43, 44 on core plates 14 of one plate pair 17 align and mate with the corresponding boss portions 43, 44 on the adjacent core plates 16 of the adjacent plate pair 17 thereby spacing the sets of core plates 14, 16 or plate pairs 17 apart from each other forming the second set of flow passages 42 therebetween.

Referring now to FIGS. 10-13, fluid openings 46, 48 are formed in respective boss portions 43, 44 of each of the core plates 14, 16. Each boss portion 43, 44 includes a flat surface 45 that surrounds each of fluid openings 46, 48 which serves as a sealing surface against which the boss portions 43, 44 of one core plate 14, 16 abuts and seals against the corresponding boss portion 43, 44 of the adjacent core plate 14, 16. Accordingly, when the core plates 14, 16 are alternatingly, stacked together, the aligned fluid openings 46, 48 form respective inlet and outlet manifolds (identified schematically by flow arrows 47, 49 in FIG. 1A) within the heat exchanger core 12, which manifolds are in fluid communication with the first set of flow passages 40, fluid inlet 24 and fluid outlet 26 being in fluid communication with manifolds 47, 49.

Core plates 14, 16 also comprise a fluid barrier 50 formed in the contour of the generally central portions 29 of the core plates 14, 16. The fluid barrier 50 is formed so that there is a first portion arranged between the pair of boss portions 43, 44, the fluid barrier 50 extending from between the pair of boss portions 43, 44 and around a portion of mid-section of the central portion 29 of the core plates 14, 16. The fluid barrier 50 formed on core plates 14 is oppositely disposed with respect to the fluid barrier 50 formed on the adjacent core plates 16 so that when the core plates 14, 16 are alternatingly stacked together, the fluid barriers 50 on core plates 14 align and sealingly mate with the fluid barriers 50 formed on the adjacent core plates 16 effectively separating the inlet flow through inlet 24 from the outlet flow 26 and creating a U-shaped or two-pass fluid channel in flow passages 40. Accordingly, fluid (for instance water or any other suitable liquid coolant) enters the heat exchanger 10 through fluid inlet 24 and is distributed through a first branch 40(1) of flow channels 40, the first branch 40(1) extending around an upper portion of plate pair 17. The fluid then travels through the U-shaped bend 51 before flowing through the second branch 40(2) of flow passages 40, the first branch 40(1) being separated from the second branch 40(2) by means of fluid barrier 50, before being discharged from the heat exchanger 10 through outlet manifold 49 and fluid outlet 26 (see for instance FIGS. 11-13).

A second pair of fluid openings 54, 56 is formed in each of the core plates 14, 16, the fluid openings 54, 56 being circumferentially spaced apart from each other, approximately 180 degrees, so as to be generally opposite to each other in the sidewall 18 of the core plates 18. Fluid openings 54, 56 are also staggered with respect to fluid openings 46, 48 forming manifolds 47, 49. Fluid openings 54, 56 are generally elongated and can occupy approximately 50% to 75% of the perimeter of the heat exchanger 10. The fluid openings 54, 56 in core plates 14 are aligned with fluid openings 54, 56 in the adjacent core plates 16, the aligned fluid openings 54, 56 providing fluid communication between the second set of flow passages 42 and the fluid inlet 20 and fluid outlet 22 of the heat exchanger 10. Accordingly, fluid (for example, air in the case of a CAC) enters the heat exchanger 10 through fluid inlet 20 and is distributed through the second set of flow passages 42 by means of the aligned fluid openings 54, 56 at the outer perimeter of the core 12 and is funneled through flow passages 42 toward the central outlet manifold, illustrated by flow arrow 21 (shown in FIG. 1A) and is discharged from the heat exchanger 10 through fluid outlet 22. Accordingly, the aligned fluid openings 54, 56 form a split, inlet manifold (illustrated by flow arrows 57) for distributing incoming air through flow channels 42, the incoming fluid being "funneled" toward the center of the heat exchanger 10 due to the conical shape of the core plates 14, 16, before discharging the fluid through the central outlet manifold 21 formed by the aligned central smaller second open ends 32 of the heat exchanger 10 and fluid outlet 22. In other embodiments where the location of the fluid inlet 20 and fluid outlet 22 are reversed, the fluid enters the bottom or smaller end of the heat exchanger 10 and is distributed to each of the flow passages 42 via the central manifold 21 before exiting the heat exchanger 10 through the split manifold openings 54, 56, the fluid therefore diverging outwardly from the central manifold 21 to openings 54, 64 before being directed out of the heat exchanger 10 through fluid opening 20.

Figure 14:
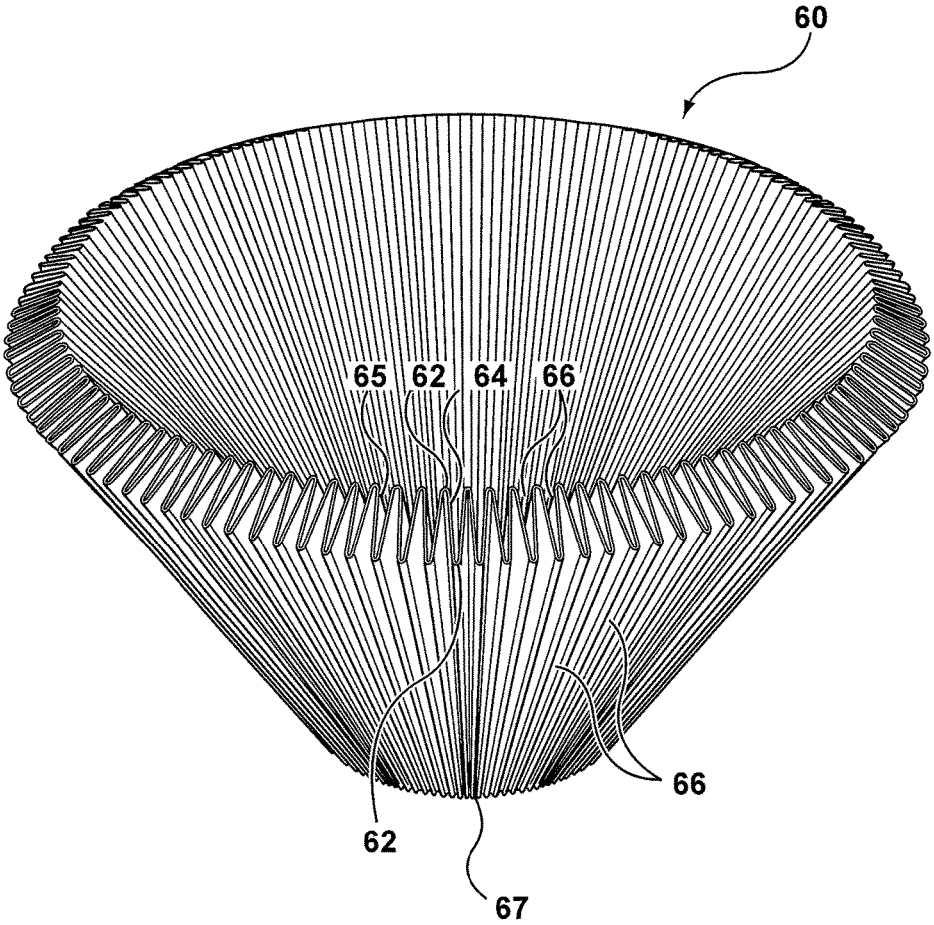
FIG. 14 is a perspective view of a heat transfer enhancement device that may be used in the heat exchanger of FIG. 1.
Figure 15:
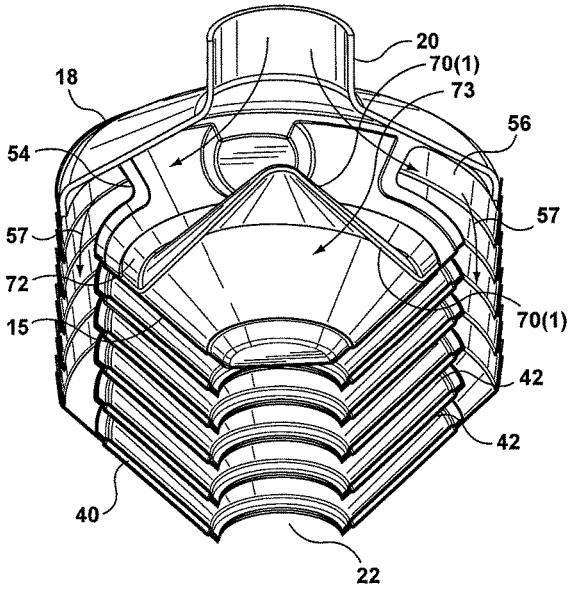
FIG. 15 is a partial cutaway view of a portion of the heat exchanger of FIG. 1A.
Figure 16:
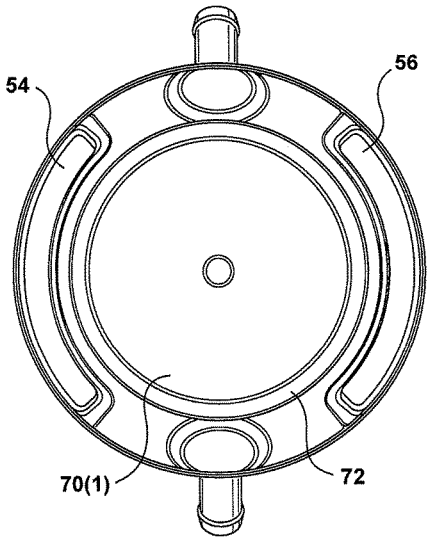
FIG. 16 is a top view of the heat exchanger of FIG. 15 with the upper end plate removed.

Although not shown in the drawings, some or all of the first and second set of flow passages 40, 42 in the core 12 may be provided with a heat transfer enhancement device 60 such as a corrugated fin or turbulizer, which may be secured to the core plates 14, 16 by brazing. An exemplary embodiment of an air-side heat transfer enhancement device 60 is shown in FIG. 14. As shown, the air-side turbulent enhancement device 60 is in the form of a corrugated fin having a generally conical form with a plurality of ridges or crests 62 connected by sidewalls 64, the ridges or crests 62 extending longitudinally along an axis parallel to the axis defined by the angled sidewalls 28 of the conical-shaped core plates 14, 16, the ridges 62 being rounded or flat and generally in contact with the sidewalls 28 forming the core plates 14, 16 when the plate pairs 17 comprised of plates 14, 16 are stacked together, the heat transfer enhancement device 60 being inserted in flow passages 42 between the adjacent plate pairs 17. The ridges 62 and interconnecting sidewalls 64 form longitudinal openings or passages 66 therebetween extending from one end of the heat transfer enhancement device 60 to the opposite end thereof. When the heat transfer enhancement device 60 is in the form of a corrugated fin it is arranged so that the openings are generally in-line with the incoming flow through fluid openings 54, 56. The generally conical shape of the air-side turbulent enhancement device 60 results in the corrugations or ridges 62 being generally spaced apart from each other by a first, larger distance 65 at the first open end which spacing gradually reduces towards the smaller, second end of the turbulent enhancement device 60 where the ridges 62 are only spaced-apart by a second, smaller distance 67. Accordingly, the open passages 66 formed between the ridges or crests 62 converge towards the second, smaller end which generally has the effect of accelerating the air flow through these regions from the inlet end 20 to the outlet end 22 of the core 12.

In the example embodiment illustrated in FIG. 1A, the heat exchanger 12 comprises an uppermost heat exchanger plate 15 that is also a conically-shaped plate that is similar in structure to heat exchanger plates 14, 16. However, rather than defining a smaller, open end 32 as in heat exchanger plates 14, 16, the uppermost heat exchanger plate 15 does not provide a central opening and instead has a closed bottom that serves to seal the central manifold passage formed by the aligned open ends 32 of the plate pairs 17 forming the heat exchanger core 12. In order to ensure proper distribution of the fluid entering heat exchanger 10 through inlet 20 towards flow passages 42 and in order to prevent fluid entering the heat exchanger 10 through inlet 20 from simply impinging and/or stagnating against the closed bottom end of the uppermost heat exchanger plate 15 or from bypassing flow passages 42 altogether and exiting the heat exchanger directly through fluid outlet 22 in embodiments where a closed uppermost heat exchanger plate 15 is not provided, a diffuser plate 70 is arranged on top of the uppermost core plate 15 in the stack forming the heat exchanger core 12. A first exemplary embodiment of the diffuser plate 70 is shown in FIGS. 1A, 1B and 15-16. As shown, the diffuser plate 70(1) of the subject exemplary embodiment is in the form of an inverted cone with a peripheral flange 72 that extends upwardly away from the central inverted cone-shaped region at an angle corresponding to the angle of the sidewall portion 28 of core plates 14, 16 so that the peripheral flange 72 abuts and seals against a portion of the sidewall 28 effectively sealing-off or enclosing a central, interior space or cavity 73 between the diffuser plate 70(1) and the uppermost heat exchanger plate 15. The outer surface of the diffuser plate 70(1) serves to direct incoming fluid from inlet 20 towards fluid openings 54, 56 forming manifold regions 57.

Figure 17:
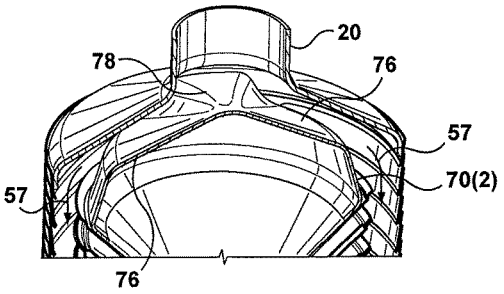
FIG. 17 is a partial cutaway view of a portion of the heat exchanger the heat exchanger of FIG. 1A according to another exemplary embodiment of the present disclosure.
Figure 18:
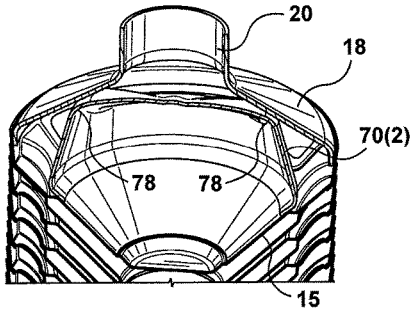
FIG. 18 is a partial cutaway view of a portion of the heat exchanger of FIG. 17 with the cutaway view being 90 degrees with respect to the view illustrated in FIG. 17.
Figure 19:
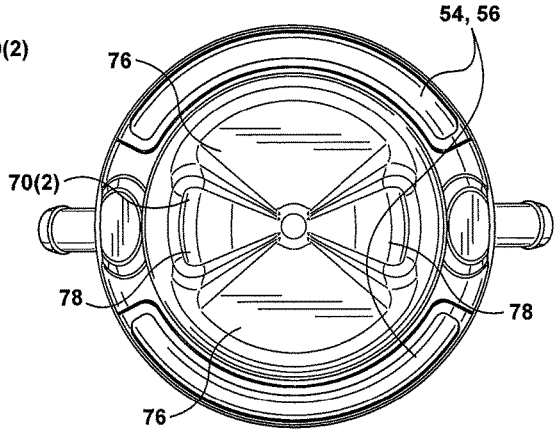
FIG. 19 is a top view of the heat exchanger of FIG. 17 with the upper end plate removed.

Referring now to FIGS. 17-19, there is shown another exemplary embodiment of diffuser plate 70. In the subject exemplary embodiment, the diffuser plate 70(2) has a downwardly or inwardly extending peripheral flange 72. The upper surface of the diffuser plate 70(2) is shaped and/or contoured in order to redirect incoming flow away from the "blocked" flow areas and towards the fluid openings 54, 56 that are in-line with or associated with the first fluid manifolds or header regions so as to promote incoming flow towards the manifold 57 or fluid openings 54, 56. Accordingly, in this embodiment the diffuser plate 70(2) has an upper surface with two oppositely disposed downwardly sloping regions 76 which serve to direct incoming flow through inlet 20 towards fluid openings 54, 56 which define the inlet header regions or manifolds 57 for the incoming flow, and two oppositely disposed raised or protruding regions 78 which serve to block incoming flow from being diverted towards the closed areas of the uppermost core plate 15. The overall size and shape of diffuser plate 70(2) is such that it substantially fills or encloses the open, interior space that is otherwise formed between end plate 18 and the uppermost core plate 15 so that the incoming fluid is channeled directly towards the fluid openings 54, 56. The shaping of diffuser plate 70(2) has been found to reduce the number of angles or bends that the incoming flow through inlet 20 needs to navigate thereby reducing the pressure drop typically experienced in some conventional or known heat exchangers or charge-air-coolers. The formation of an enclosed, interior cavity 73 between the diffuser plate 70(1), 70(2) and the uppermost core plate 15 is also useful in situations where additional functionality can be incorporated into the heat exchanger 10 by housing additional components with the interior cavity 73 or otherwise making use of this space 73 without having to add to the overall size or footprint of the heat exchanger 10. In embodiments where the locations of inlet and outlets 20, 22 are reversed with the flow entering the heat exchanger through the smaller end of the heat exchanger through fluid opening 22 and exits the heat exchanger 10 through fluid opening 20, the diffuser plate 70(1), 70(2) provides the same function in that it helps to direct the flow from the fluid openings 54, 56 to the outlet opening 20.

Figures 20A, 20B:
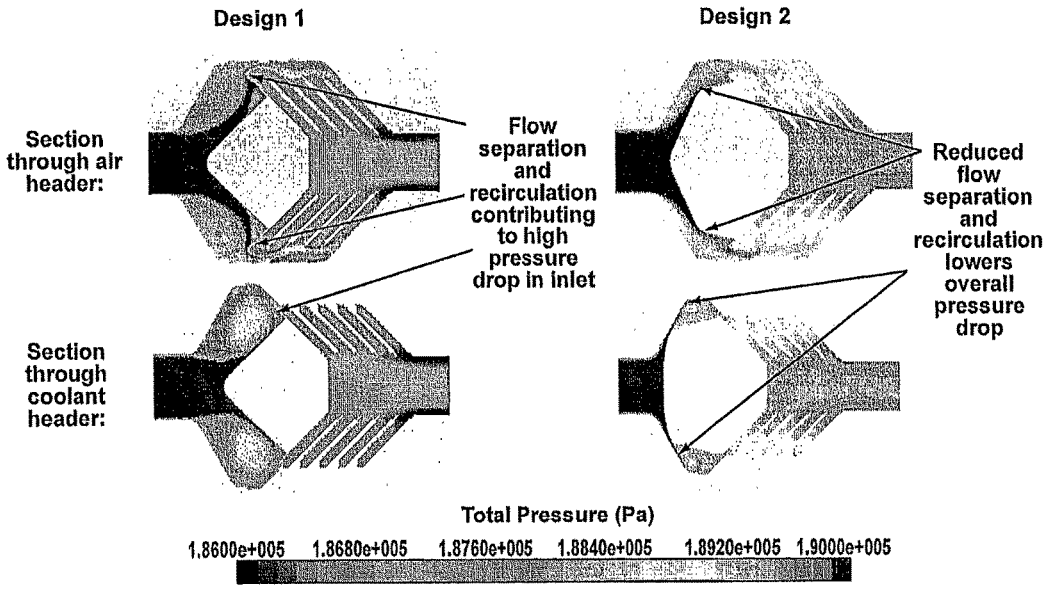
FIGS. 20A and 20B illustrate the total pressure drop through the heat exchanger core of the heat exchangers shown in FIGS. 15 and 17, respectively.
Figures 21A, 21B:
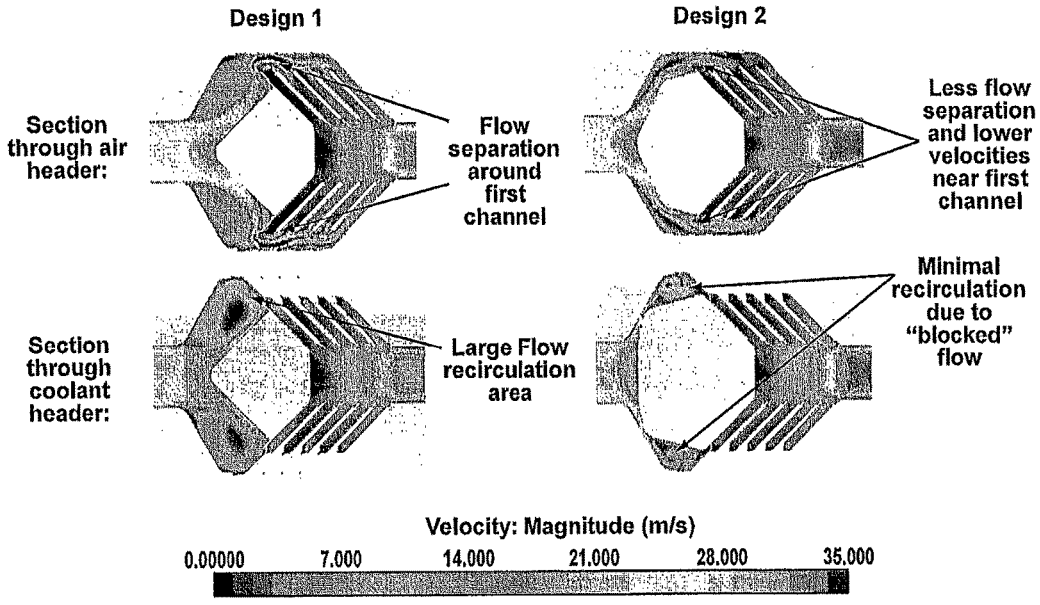
FIGS. 21A and 21B illustrate the flow velocity through the heat exchanger core of the heat exchangers shown in FIGS. 15 and 17, respectively.

FIGS. 20 and 21 illustrate the results of flow velocity and pressure analysis on a heat exchanger 10 employing each type of diffuser plate 70(1), 70(2). As illustrated by the test data of FIGS. 20A and 21A, diffuser plate 70(1) tends to demonstrate higher pressure drop through the heat exchanger 10 for fluid entering the heat exchanger 10 through inlet 20 due to the flow having to navigate the steeper upward slope formed at the intersection of the diffuser plate 70(1) and the upper core plate 14 which causes flow separation as well as recirculation zones in the fluid before the fluid enters manifold regions 57 through fluid openings 54, 56 and the corresponding fluid channels 42. As illustrated by the test data of FIGS. 20B and 21B, diffuser plate 70(2) provides improved or more even flow velocity through the heat exchanger 10 which improves pressure drop through the core 12 and reduces the recirculation zones at the inlet which also improves pressure drop and in turn, overall heat transfer performance.

Figure 24:
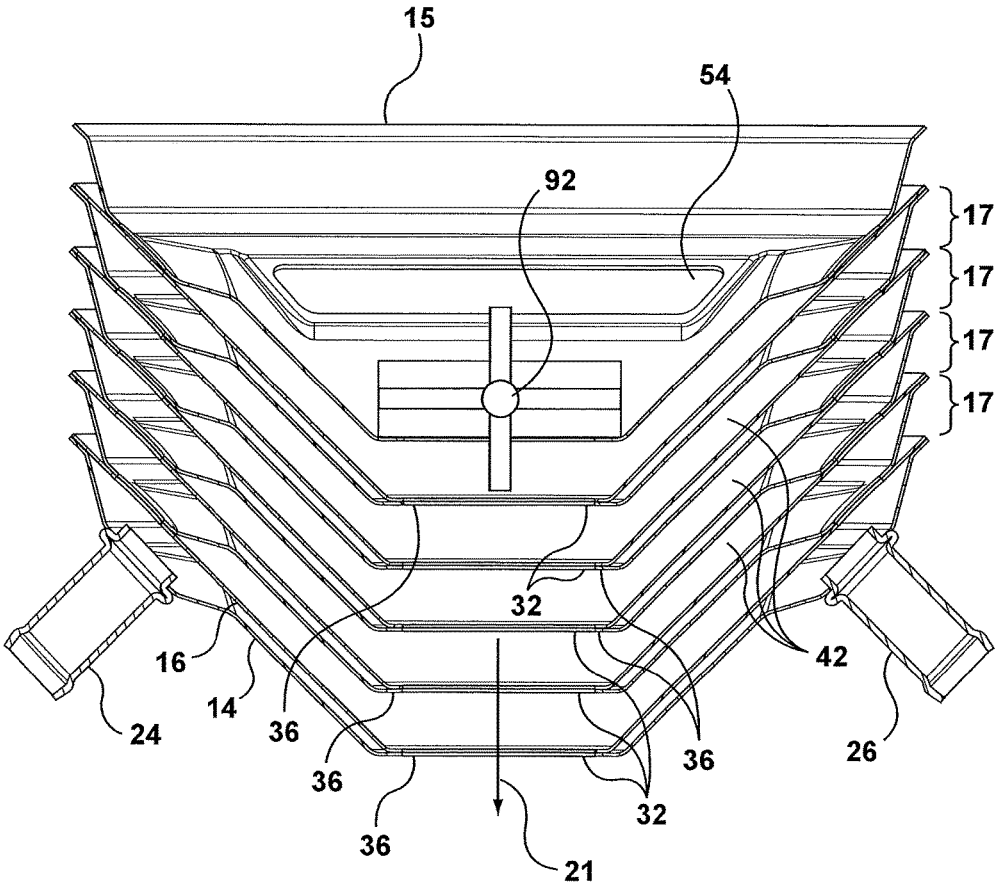
FIG. 24 is a schematic, cutaway view of a portion of a heat exchanger according to an alternate embodiment of the present disclosure illustrating a bypass function incorporated into the heat exchanger.

Referring now to FIG. 24, there is shown an alternate embodiment of the heat exchanger 10. In the subject exemplary embodiment, rather than having a diffuser plate 70 arranged at the inlet end of the heat exchanger 10 for directing incoming flow towards fluid inlet openings 54, 56, in some instances it may be beneficial to have a valve mechanism 92 arranged within the central fluid passage 21 at the inlet end of the heat exchanger 10 for controlling flow through the heat exchanger 10. More specifically, the valve mechanism 92, which may be in the form of a butterfly valve having a valve disk or valve flap can be arranged within uppermost opening 32 defined by the flanged ends 36 of the uppermost plate pair 17, the valve mechanism 92 having a first, closed position wherein the valve disk or flap covers or blocks-off the central fluid passage 21 effectively preventing fluid from entering the heat exchanger 10 through inlet 20 due to the increased fluid resistance created by the closed valve mechanism 92, and having a second, open position wherein the flap arranged in-line with the central axis of the heat exchanger 10 allowing fluid to pass freely through the heat exchanger 10. The valve mechanism 92 can be electronically control through a control system or may be a mechanical valve that operates based on temperature, pressure, etc. to provide for an operating condition where fluid bypasses the heat exchanger 10 and is directed elsewhere in the overall system or is directed to the heat exchanger 10 for heating/cooling based on different operating conditions. Accordingly, by incorporating the valve mechanism 92 into the central flow passage 21 of the heat exchanger 10, heat exchanger 10 can be adapted for operation within various systems and can be specifically tuned for various operating conditions. While the use of a valve mechanism 92 has been described primarily with the valve mechanism 92 being arranged within the central flow passage 21 defined by open edges 36 of the heat exchanger plates 14, 16 proximal the fluid inlet 20, it will be understood that the valve mechanism 92 can also be incorporated into the heat exchanger 10 at the opposite end of the heat exchanger 10 in instances where the fluid inlet and outlet 20, 21 are reversed.

Figure 25:
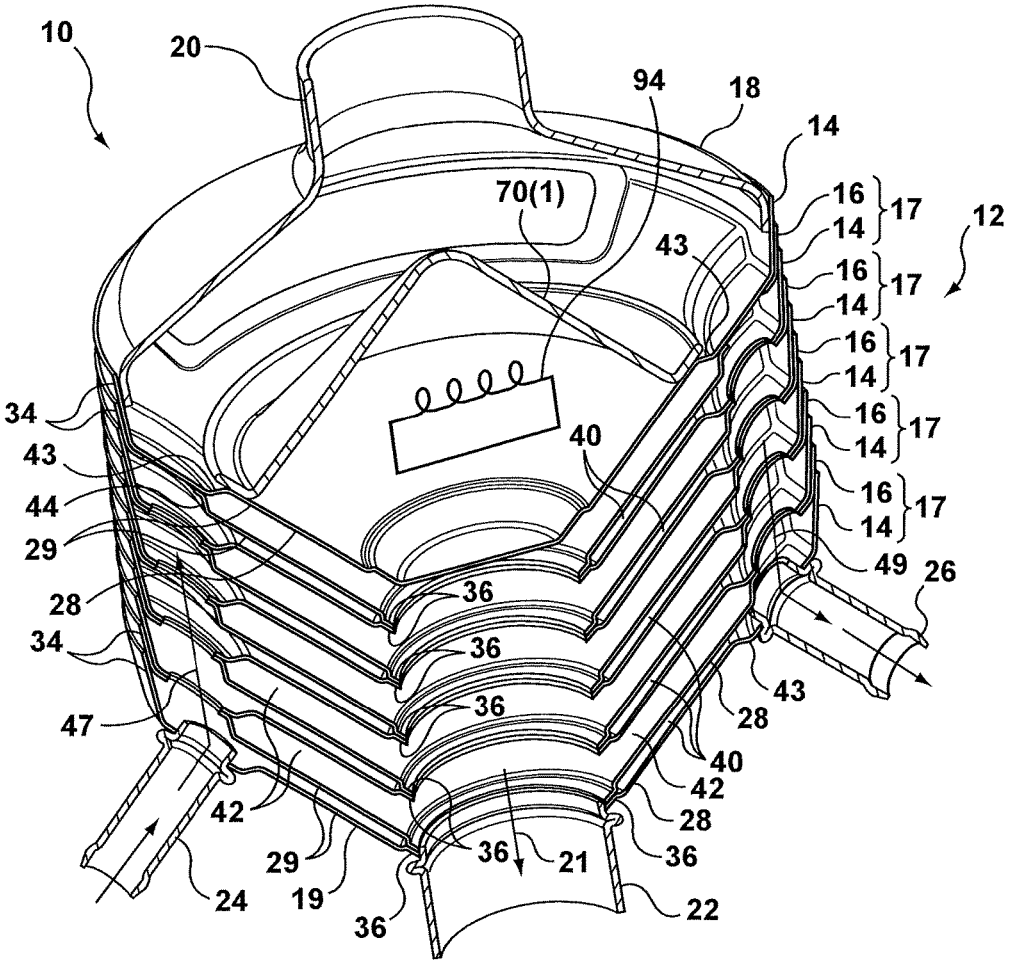
FIG. 25 is a perspective, cutaway view of a heat exchanger according to an alternate embodiment of the present disclosure.
Figure 26:
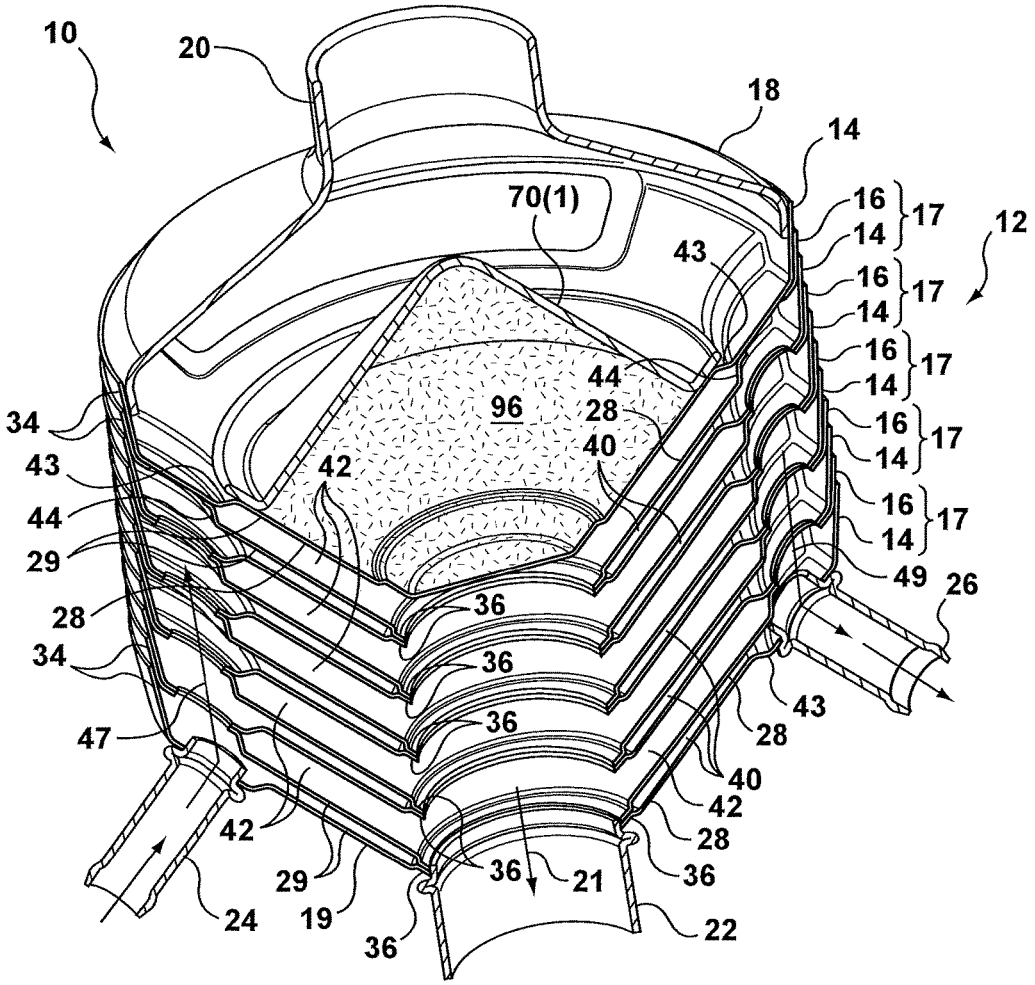
FIG. 26 is a perspective, cutaway view of a heat exchanger according to an alternate embodiment of the present disclosure.

Referring now to FIGS. 25 and 26 there is shown another embodiment of the heat exchanger 10 according to the present disclosure. Depending upon the particular application for heat exchanger 10, in some instances it may be desirable to pre-heat one of the incoming fluids, especially when the heat exchanger 10 is being used for engine and/or cabin warm-up applications in cold-start conditions. Accordingly, in some embodiments, an electric heater 94 can be incorporated into the interior space or cavity 73 defined between the diffuser plate 70 and the uppermost heat exchanger plate 15. Therefore, as fluid enters the heat exchanger through inlet 20, the incoming fluid is pre-heated or warmed by way of the heat generated within the inlet end of the heat exchanger 10 by the electric heater 94. The electric heater 94 can be arranged within the interior cavity 73 formed under the diffuser plate 70 with appropriate openings and/or wiring conduits being provided in the diffuser plate 70 and end plate 18 of the heat exchanger 10 to ensure proper operation of the device in accordance with principles known in the art.

In other instances it may be desirable to increase the heat transfer or cooling effect of heat exchanger 10 by further decreasing the temperature of the incoming fluid. In such applications, the interior cavity 73 can be filled with a phase change material 96 (illustrated schematically by hatched lines in FIG. 26). Therefore, as the incoming fluid impinges on and/or against the diffuser plate 70, additional heat is drawn away from the incoming fluid as the heat is conducted through the very thin wall of the diffuser plate 70 and taken up by the phase change material providing for additional localized cooling of the incoming fluid. Accordingly, it will be understood that in embodiments of the heat exchanger 10 that incorporate the diffuser plate 70, the interior cavity 73 formed between the diffuser plate 70 and the uppermost heat exchanger plate 15 can be used for various purposes to further adapt heat exchanger 10 to a particular application.

While heat exchanger 10 has been described as a self-enclosing heat exchanger due to the structure of the core plates 14, 16 both having upwardly extending peripheral flanges 34 that nest together in sealing relationship when the plates 14, 16 are alternatingly stacked together to form the core 12, it will be understood that the core plates 14, 16 may be modified in order to form a heat exchanger core 12 that is housed within a separate outer casing or housing.

Figure 22:
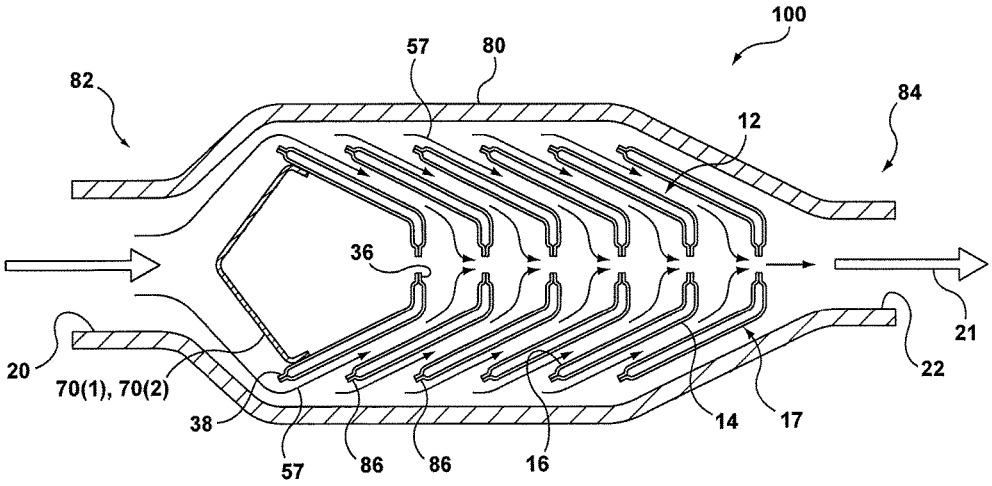
FIG. 22 is a schematic, cross-sectional view of a heat exchanger according to another exemplary embodiment of the present disclosure.
Figure 23:
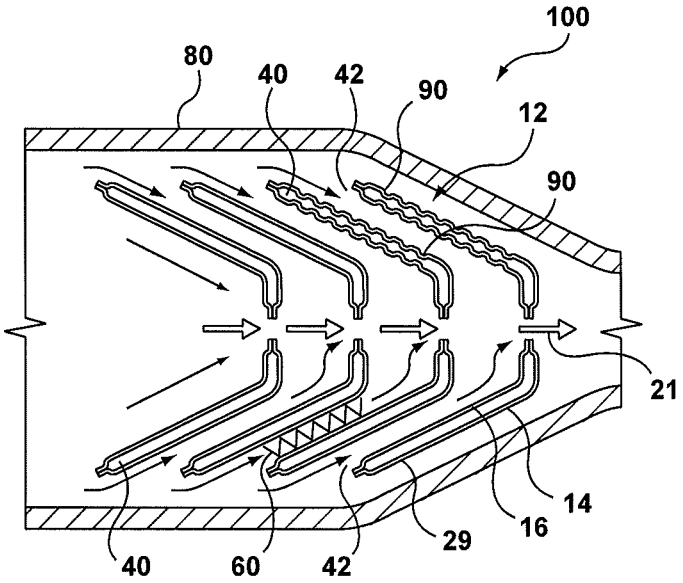
FIG. 23 is a detail schematic cross-section view of a portion of the heat exchanger shown in FIG. 22.

Referring now to FIGS. 22 and 23, there is shown yet another exemplary embodiment of the present disclosure wherein the heat exchanger core is enclosed within an outer housing wherein like reference numerals will be used to identify similar features. As shown, heat exchanger 100 is comprised of a heat exchanger core 12 that is enclosed within a separate, outer housing 80. The outer housing 80 has a first end 82 in the form of fluid inlet 20 and a second end 84 in the form of fluid outlet 22. Modified core plates 14, 16 are alternatingly stacked together to form the core 12 with the boss portions 43, 44 (not shown) on one core plate 14, aligning and mating with the corresponding boss portions 43, 44 (not shown) formed on the adjacent plate 16 thereby spacing the plates 14, 16 apart from each other and forming alternating flow passages 40, 42. In this embodiment, however, rather than having an upwardly extending flange 34 extending away from the first, open end 30 of the plates 14, 16, a peripheral flange 86 that extends at an angle generally parallel to the angle of the conically-shaped sidewall 18 encircles the first open end of the plates 14, 16 similar to the peripheral flange 36 formed at the second, open end of the plates 14, 16. Peripheral flanges 36, 38 serve to seal the interior space formed between the spaced-apart sidewalls regions 29 of adjacent plates 14, 16 that form flow passages 40. Although not shown in the drawings, corresponding inlet and outlet fittings 24, 26 extend through the outer housing 80 to establish fluid communication between the fluid source and flow passages 40 within the heat exchanger core 12.

Use of the above-described heat exchanger 100 as a liquid-to-liquid oil cooler will now be described in further detail. In the subject exemplary embodiment, the heat exchanger core 12 comprised of a stack of plate pairs 17 formed from an alternating arrangement of conical-shaped core plates 14, 16 is arranged within outer housing 80. A diffuser plate 70(1), 70(2) is arranged at one end of the stack generally in-line with fluid inlet 20 at the first end 82 of the outer housing 80. Accordingly, any suitable coolant, for example water, enters the heat exchanger 100 through inlet 20 of the outer housing 80 and is distributed through flow passages 42 formed between the spaced-apart plate pairs 17 and within the space surrounding the heat exchanger core 12 within the housing 80 and is directed through the aligned central openings 32 of the plates 14, 16 before exiting the housing 80 through outlet 22 at the second end 84 of the housing 80. A second fluid, for example engine oil or transmission oil, or any other suitable fluid, enters the heat exchanger outer housing 80 through fluid inlet 24 (not shown in the drawings), fluid inlet 24 directing the second fluid through flow passages 40 before being discharged from the heat exchanger through fluid outlet 26 (not shown). Heat transfer enhancement devices 60, such as a corrugated fin as described above in connection with FIG. 14 may be positioned between the plate pairs 17 in flow passages 42. The conical shape of the corrugated fin surface 60 causes the spacing of the corrugations to be larger at the first inlet end of the flow passages and smaller or closer together at the smaller diameter second open end of the flow passages 42. This contraction within the form of the heat transfer surface or corrugated fin tends to accelerate the flow of fluid through flow passages 42 which effectively decreases the boundary layer growth/formation and increases overall heat transfer performance through the core 12. The central regions 29 of the sidewalls 28 that form the core plates 14, 16 may further comprise dimples, ribs or other forms of protrusions 90 that are intended to extend into the flow passages so as to increase turbulence within the fluid flow in the flow passage 40 so as to further enhance overall heat transfer performance Whether heat exchanger 10, 100 is a self-enclosing heat exchanger 10 as shown in FIGS. 1-21 or a heat exchanger 100 with an outer housing 80 as shown in FIGS. 22-23, the inline arrangement of the inlet and outlet 20, 22 for one of the fluids entering the heat exchanger 10, 100 allows the heat exchanger 10, 100 to be arranged in-line with fluid piping which reduces the need for bends and other additional fluid fittings that may otherwise be required to establish the required fluid connections, all of which tend to contribute to pressure drop within the overall system. Furthermore, the general conical shape of the heat exchanger core 12 also reduces the need for fluid flowing through the heat exchanger to make multiple 90 degree bends, which are often found in other heat exchanger structures, once again improving overall pressure drop through the heat exchanger 10, 100.

While various exemplary embodiments have been described, it will be understood that certain adaptations and modifications of the described embodiments can be made. Therefore, the above discussed embodiments are considered to be illustrative and are not intended to be restrictive.

What is claimed is:

1. A heat exchanger comprising:

a heat exchanger core comprising a plurality of alternatingly stacked conically-shaped core plates defining a first set of flow passages between adjacent plates in a plate pair and a second set of flow passages between adjacent plate pairs forming the heat exchanger core, the first set of flow passages and the second set of flow passages being in alternating order through the heat exchanger core;

a pair of first inlet manifolds in fluid communication with said second set of flow passages, wherein the pair of first inlet manifolds are disposed circumferentially opposite to each other at the perimeter of the heat exchanger core;

a first outlet manifold in fluid communication with said second set of flow passages, the outlet manifold being formed centrally through the heat exchanger core;

a second inlet manifold in fluid communication with said first set flow passages, said second inlet manifold formed within the perimeter of the heat exchanger core;

a second outlet manifold in fluid communication with said first set of flow passages, said second outlet manifold formed within the perimeter of the heat exchanger core;

wherein the first set flow passages extend circumferentially around the perimeter of the conically-shaped core plates forming the plate pairs, and the second set of flow passages extend at an angle, with respect to a central longitudinal axis of the heat exchanger, that is parallel to the angle defined by the conically-shaped core plates between said plate pairs.

2. The heat exchanger as claimed in claim 1, wherein the pair of first inlet manifolds are formed within the perimeter of the heat exchanger core such that the heat exchanger core is self-enclosed.

3. The heat exchanger as claimed in claim 1, wherein the heat exchanger core is arranged within an outer housing, the pair of first inlet manifolds being formed between the heat exchanger core and an inner surface of the outer housing.

4. The heat exchanger as claimed in claim 1, further comprising an inlet end defining a first fluid inlet in fluid communication with said pair of first inlet manifolds and an outlet end defining a first fluid outlet in fluid communication with said first outlet manifold, wherein said inlet end and said outlet end are longitudinally opposite to each other, said first fluid inlet and said first fluid outlet being axially in-line with each other.

5. The heat exchanger as claimed in claim 4, further comprising a second fluid inlet in communication with said second inlet manifold and a second fluid outlet in fluid communication with said second outlet manifold, wherein said second fluid inlet and outlet are arranged proximal said outlet end of said heat exchanger.

6. The heat exchanger as claimed in claim 4, further comprising a diffuser plate arranged at said inlet end of the heat exchanger in sealing contact with said heat exchanger core, the diffuser plate directing incoming flow to said pair of inlet manifolds.

7. The heat exchanger as claimed in claim 6, wherein said diffuser plate is in the form of an inverted cone.

8. The heat exchanger as claimed in claim 6, wherein said diffuser plate has an upper, domed surface formed with a pair of sloping regions for directing incoming flow to said pair of inlet manifolds and a pair of protruding regions for directing incoming flow away from areas associated with said second inlet and second outlet manifolds.

9. The heat exchanger as claimed in claim 2, wherein said pair of first inlet manifolds are formed by a pair of circumferentially opposed fluid openings formed in said conically-shaped core plates, the fluid openings in one core plate being aligned with the fluid openings in an adjacent core plate forming said pair of first inlet manifolds.

10. The heat exchanger as claimed in claim 9, wherein said circumferentially opposed fluid openings are elongated and occupy 50%-75% of the perimeter of the conically-shaped heat exchanger core.

11. The heat exchanger as claimed in claim 1, further comprising a heat transfer enhancement device arranged in said second set of flow passages, wherein said heat transfer enhancement device is in the form of a conically-shaped corrugated fin comprised of a series of spaced-apart ridges interconnected by sidewalls extending from a first end having a first diameter to a second end having a second diameter, wherein said second diameter is smaller than said first diameter, and said spaced-apart ridges converge towards each other between said first and second ends.

12. The heat exchanger as claimed in claim 1, wherein said first set of flow passages are formed by spaced-apart walls of adjacent core plates, said spaced-apart walls being formed with flow enhancement features extending into said first set of flow passages.

13. The heat exchanger as claimed in claim 12, wherein said flow enhancement features are in the form of dimples.

14. The heat exchanger as claimed in claim 1, wherein said first set of flow passages define a two-pass fluid path, said second fluid inlet and said second fluid outlet being arranged generally adjacent to each other and being separated from each other by a fluid barrier formed in said core plates forming said first set of flow passages.

15. The heat exchanger as claimed in claim 3, wherein, said heat exchanger is a liquid-to-liquid heat exchanger, wherein said first fluid is a liquid coolant and said second fluid is one of the following alternatives: engine oil or transmission oil.

16. The heat exchanger as claimed in claim 1, further comprising a valve mechanism arranged within said first outlet manifold, the valve mechanism having a closed position for sealing said first outlet manifold and directing incoming fluid away from said first inlet manifold, and an open position allowing fluid to flow freely through said first inlet and outlet manifolds.

17. The heat exchanger as claimed in claim 6, wherein an interior cavity is defined between said diffuser plate and said heat exchanger core.

18. The heat exchanger as claimed in claim 17, wherein said interior cavity is adapted for housing an electric heater for pre-heating an incoming fluid.

19. The heat exchanger as claimed in claim 17, wherein said interior cavity is adapted for housing a phase change material, the phase change material being in heat transfer relationship with an incoming fluid.

20. The heat exchanger as claimed in claim 1, wherein said first fluid is air and said second fluid is a liquid.

21. A heat exchanger comprising:

a heat exchanger core comprising a plurality of alternatingly stacked conically-shaped core plates defining a first set of flow passages between adjacent plates in a plate pair and a second set of flow passages between adjacent plate pairs forming the heat exchanger core, the first set of flow passages and the second set of flow passages being in alternating order through the heat exchanger core;

a pair of first inlet manifolds in fluid communication with said second set of flow passages, wherein the pair of first inlet manifolds are disposed opposite to each other at the perimeter of the heat exchanger core;

a first outlet manifold in fluid communication with said second set of flow passages, the outlet manifold being formed centrally through the heat exchanger core;

a second inlet manifold in fluid communication with said first set flow passages, said second inlet manifold formed within the perimeter of the heat exchanger core;

a second outlet manifold in fluid communication with said first set of flow passages, said second outlet manifold formed within the perimeter of the heat exchanger core; and a heat transfer enhancement device disposed in said second set of flow passages, wherein said heat transfer enhancement device is in the form of a conically-shaped corrugated fin comprised of a series of spaced-apart ridges interconnected by sidewalls extending from a first end having a first diameter to a second end having a second diameter, wherein said second diameter is smaller than said first diameter, and said spaced-apart ridges converge towards each other between said first and second ends;

wherein flow through the first set flow passages is peripheral around the perimeter of the conically-shaped core plates forming the plate pairs, and flow through the second set of flow passages is along the angle defined by the conically-shaped core plates between said plate pairs between the sidewalls of the corrugated fin.

22. The heat exchanger as claimed in claim 21, wherein:

said pair of first inlet manifolds are formed by a pair of circumferentially opposed fluid openings formed in said conically-shaped core plates, the fluid openings in one core plate being aligned with the fluid openings in an adjacent core plate forming said pair of first inlet manifolds; and wherein said circumferentially opposed fluid openings are elongated and occupy 50%-75% of the perimeter of the conically-shaped heat exchanger core.

23. The heat exchanger as claimed in claim 21, further comprising:

an inlet end defining a first fluid inlet in fluid communication with said pair of first inlet manifolds and an outlet end defining a first fluid outlet in fluid communication with said first outlet manifold, wherein said inlet end and said outlet end are longitudinally opposite to each other, said first fluid inlet and said first fluid outlet being axially in-line with each other; and a second fluid inlet in communication with said second inlet manifold and a second fluid outlet in fluid communication with said second outlet manifold, wherein said second fluid inlet and outlet are arranged proximal said outlet end of said heat exchanger.

24. The heat exchanger as claimed in claim 23, further comprising a diffuser plate arranged at said inlet end of the heat exchanger in sealing contact with said heat exchanger core, the diffuser plate having an upper, domed surface formed with a pair of sloping regions for directing incoming flow to said pair of inlet manifolds and a pair of protruding regions for directing incoming flow away from areas associated with said second inlet and second outlet manifolds.

25. A heat exchanger comprising:

a plurality of plate pairs disposed in a stack such that each plate pair is spaced apart from an adjacent plate pair, each plate pair including first and second conically-shaped core plates, wherein each conically-shaped core plate comprises:

a conically-shaped sidewall extending between a first end having a, first diameter and a second end having a second diameter, wherein the second diameter is smaller than the first diameter;

a first flange extending away from the first end of the conically-shaped sidewall; and a second flange extending from the second end of the conically-shaped sidewall;

wherein the first and second conically-shaped core plates are cooperatively configured such that:

while the first and second conically-shaped core plates are stacked together forming plate pairs, the conically-shaped sidewall of the first plate is spaced apart from the conically-shaped sidewall of the second plate in each plate pair defining a gap therebetween, and the first flange of the first core plate in a plate pair sealingly engages the first flange of the second core plate and the second flange of the first core plate sealingly engages the second flange of the second core plate in the plate pair;

a first set of flow passages disposed between the spaced-apart conically shaped-sidewalls of the plate pairs such that the first set of flow passages extend circumferentially around the gap formed between the spaced apart conically-shaped sidewalls of the first and second core plates;

a second set of flow passages disposed between the spaced-apart plate pairs such that the second set of flow passages taper between a first end to a second end at an angle, with respect to a central longitudinal axis of the heat exchanger, that is parallel to the angle defined by the conically-shaped sidewall of the first and second core plates with respect to the central longitudinal axis of the heat exchanger;

a pair of first inlet manifolds in fluid communication with the second set of flow passages, wherein the pair of first inlet manifolds are disposed circumferentially opposite to each other, the pair of first inlet manifolds distributing a first fluid to an inlet end of said second set of flow passages;

a first outlet manifold in fluid communication with an outlet end of the second set of flow passages wherein the first outlet manifold is disposed along a central longitudinal axis of the heat exchanger;

a second inlet manifold in fluid communication with the first set of flow passages for distributing a second fluid to an inlet end of the first set of flow passages;

a second outlet manifold in fluid communication with said first set of flow passages for discharging the second fluid from the first set of flow passages;

wherein the second inlet manifold and the second outlet manifold are disposed within the conically-shaped sidewalls of the plate pairs.

26. The heat exchanger as claimed in claim 25, wherein the plurality of plate pairs are cooperatively configured such that the first flange of the second plate in a first plate pair sealingly engages the first flange of the first core plate in an adjacent plate pair thereby spacing apart one plate pair from an adjacent plate pair, the sealing engagement of the first flanges of the plurality of plate pairs defining an outer perimeter of the heat exchanger such that the heat exchanger core is self-enclosed.

27. The heat exchanger as claimed in claim 26, further comprising:

an end plate disposed at a first end of the heat exchanger defined by the sealingly engaged first flanges of a last plate pair in the plurality of plate pairs, the end plate defining a first fluid inlet in fluid communication with said pair of first inlet manifolds;

a first fluid outlet disposed at a second, opposite end of the heat exchanger in fluid communication with said first outlet manifold, wherein said first fluid inlet and said first fluid outlet end are disposed longitudinally opposite to each other along the central longitudinal axis of the heat exchanger;

a second fluid inlet in fluid communication with said second inlet manifold; and a second fluid outlet in fluid communication with said second outlet manifold, wherein said second fluid inlet and outlet are disposed proximal said outlet end of said heat exchanger.

28. The heat exchanger as claimed in claim 27, further comprising:

a diffuser plate disposed intermediate the end plate and the first end of the heat exchanger in sealing contact with said heat exchanger core wherein the diffuser plate is configured for directing incoming flow to said pair of first inlet manifolds, the diffuser plate having an upper, domed surface formed with a pair of sloping regions for directing incoming flow to said pair of inlet manifolds.

29. The heat exchanger as claimed in claim 27, wherein said pair of first inlet manifolds are formed by a pair of circumferentially opposed fluid openings formed in said conically-shaped core plates, the fluid openings in one core plate being aligned with the fluid openings in an adjacent core plate forming said pair of first inlet manifolds; and wherein said circumferentially opposed fluid openings are elongated and occupy 50%-75% of the perimeter of the conically-shaped heat exchanger core.

30. The heat exchanger as claimed in claim 25, further comprising a heat transfer enhancement device arranged in said second set of flow passages, wherein said heat transfer enhancement device is in the form of a conically-shaped corrugated fin comprised of a series of spaced-apart ridges interconnected by sidewalls extending from a first end having a first diameter to a second end having a second diameter, wherein said second diameter is smaller than said first diameter, and said spaced-apart ridges converge towards each other between said first and second ends.

31. The heat exchanger as claimed in claim 25, wherein said first set of flow passages define a two-pass fluid path, said second fluid inlet and said second fluid outlet being disposed adjacent to each other and being fluidly isolated from each other by a fluid barrier formed in said core plates of each of said plate pairs.

32. The heat exchanger as claimed in claim 28, wherein an interior cavity is defined between said diffuser plate and said heat exchanger core for housing one of the following alternatives: an electric heater for pre-heating an incoming fluid, or a phase change material disposed in heat transfer relationship with an incoming fluid.

* * * * *